US005145346A

United States Patent [19]

Iio et al.

[11] Patent Number: 5,145,346

[45] Date of Patent: Sep. 8, 1992

[54] SCROLL TYPE FLUID MACHINERY HAVING A TILT REGULATING MEMBER

[75] Inventors: Takayuki Iio; Ryuhei Tanigaki, both of Nishikasugai, Japan

[73] Assignee: Mitsubishi Jukogyo Kabushiki Kaisha, Tokyo, Japan

[21] Appl. No.: 713,057

[22] Filed: Jun. 10, 1991

[30] Foreign Application Priority Data

Dec. 6, 1990 [JP] Japan ..... 2-401481[U]

[51] Int. Cl.[5] ..... F01C 1/04; F01C 17/06

[52] U.S. Cl. ..... 418/55.5; 418/57; 418/151

[58] Field of Search ..... 418/55.5, 57, 151

[56] References Cited

U.S. PATENT DOCUMENTS

| | | | |
|---|---|---|---|
| 3,986,799 | 10/1976 | McCullough | 418/57 |
| 4,082,484 | 4/1978 | McCullough | 418/57 |
| 4,439,118 | 3/1984 | Iimori | 418/55.5 |
| 4,522,574 | 6/1985 | Arai et al. | 418/151 |
| 4,580,956 | 4/1986 | Takahashi et al. | 418/55.5 |
| 4,808,094 | 2/1989 | Sugimoto et al. | 418/55.5 |
| 4,824,346 | 4/1989 | Hiraga et al. | 418/55.5 |

FOREIGN PATENT DOCUMENTS

| | | |
|---|---|---|
| 0078148 | 3/1984 | European Pat. Off. . |
| 3338737 | 5/1984 | Fed. Rep. of Germany . |

*Primary Examiner*—John J. Vrablik

[57] ABSTRACT

A scroll type fluid machinery provided with a slide type radius of revolution variable mechanism prevents unilateral working of a rotating bearing 23 due to tilted rotation of a drive bushing 21 and a balance weight 27 fixed thereto. A bolt 41 for regulating tilted rotation is projected at an inner end of a rotary shaft 7, a shaft portion 41*a* therefor penetrates through a hole 42 bored in the balance weight 27, and a bearing surface 41*c* of a head 41*b* thereof is brought into slidable contact with the inner end surface of the balance weight 27. When the radius of revolution is varied at the time of revolution in a solar motion of a revolving scroll 14, an eccentric driving pin 25 slides in a slide groove 24 and the shaft portion 41*a* of the bolt 41 slides in hole 42 at the same time. In the interim, the bearing surface 41*c* of the head into slidable contact with the inner end surface of the balance weight 27, thereby to suppress tilted rotation of the balance weight 27.

4 Claims, 5 Drawing Sheets

SCROLL TYPE FLUID MACHINERY HAVING A TILT REGULATING MEMBER

FIELD OF THE INVENTION AND RELATED ART STATEMENT

The present invention relates to a scroll type fluid machinery used as a compressor, an expansion machine and the like.

FIG. 5 shows an example of a conventional scroll type compressor.

In FIG. 5, a closed housing 1 consists of a cup-shaped body 2, a front end plate 4 fastened to the cup-shaped body 2 with a bolt 3, and a cylindrical member 6 fastened to the front end plate 4 with a bolt 5. A rotary shaft 7 which penetrates through the cylindrical member 6 is supported rotatably by the housing 1 through bearings 8 and 9.

A stationary scroll 10 and a revolving scroll 14 are disposed in the housing 1.

The stationary scroll 10 is provided with an end plate 11 and a spiral wrap 12 set up on the inner surface thereof, and the stationary scroll 10 is fixed in the housing 1 by fastening the end plate 11 to the cup-shaped body 2 with a bolt 13. The inside of the housing 1 is partitioned by having the outer circumferential surface of the end plate 11 and the inner circumferential surface of the cup-shaped body 2 come in close contact with each other, thus forming a discharge cavity 31 on the outside of the end plate 11 and delimiting a suction chamber 28 inside the end plate 11. Further, a discharge port 29 is bored at the center of the end plate 11, and the discharge port 29 is opened and closed by means of a discharge valve 30.

The revolving scroll 14 is provided with an end plate 15 and a spiral wrap 16 which is set up on the inner surface thereof, and the spiral wrap 16 has substantially the same configuration as that of the spiral wrap 12 of the stationary scroll 10.

The revolving scroll 14 and the stationary scroll 10 are eccentric with respect to each other by the radius of revolution in a solar motion, and are engaged with each other while shifting an angle by 180° as shown in the figure. Then, chip seals 17 buried in the tip surface of the spiral wrap 12 come into close contact with the inner surface of the end plate 15, chip seals 18 buried in the tip surface of the spiral wrap 16 come into close contact with the inner surface of the end plate 11, and side surface of the spiral wraps 12 and 16 come into linear contact with each other at a plurality of locations, thus forming a plurality of compression chambers 19*a* and 19*b* which form almost point symmetry with respect to the center of the spiral.

A drive bushing 21 is fitted rotatably in a cylindrical boss 20 which is projected at a central part of the outer surface of the end plate 15 through a rotating bearing 23, and an eccentric driving pin 25 projected eccentrically at the inner end of the rotary shaft 7 is fitted slidably into a slide groove 24 which is bored in the drive bushing 21. Further, a balance weight 27 for balancing dynamic unbalance caused by revolution in a solar motion of the revolving scroll 14 is installed on the drive bushing 21.

Besides, a thrust bearing 36 is interposed between a peripheral edge of the outer surface of the end plate 15 and the inner surface of the front end plate 4. A mechanism 26 for checking rotation on its axis consists of an Oldham's link which allows revolution in a solar motion of the revolving scroll but checks rotation on its axis thereof, and a balance weight 37 fixed to the rotary shaft 7.

Now, when the rotary shaft 7 is rotated, the revolving scroll 14 is driven through a revolution drive mechanism consisting of the eccentric driving pin 25, the drive bushing 21, the boss 20 and the like, and the revolving scroll 14 revolves in a solar motion on a circular orbit having the radius of revolution in a solar motion, viz., an eccentric quantity between the rotary shaft 7 and the eccentric driving pin 25 as the radius while being checked to rotate on its axis by means of the mechanism 26 for checking rotation on its axis. Then, the linear contact portion between the spiral wraps 12 and 16 moves gradually toward the center of the spiral. As a result, the compression chambers 19*a* and 19*b* move toward the center of the spiral while reducing the volume thereof.

The gas which flows into a suction chamber 28 through a suction port not shown is taken into respective compression chambers 19*a* and 19*b* through outer end opening portions of the spiral wraps 12 and 16 in keeping with the above and reaches a chamber 22 at the center while being compressed. The gas passes further through a discharge port 29, pushes a discharge valve 30 open and is discharged into a discharge cavity 31, and flows out therefrom through a discharge port not shown.

When the revolving scroll 14 is revolving in a solar motion, centrifugal force toward an eccentric direction of the revolving scroll 14 and gas force by the compressed gas in respective compression chambers 19*a* and 19*b* act on the revolving scroll 14, and the revolving scroll 14 is pushed in a direction of increasing the radius of revolution by resultant force of these forces. Thus, the side surface of the wrap 16 thereof comes in close contact with the side surface of the wrap 12 of the stationary scroll 10, thereby to prevent leakage of the gas in the compression chambers 19*a* and 19*b*. Then, when the side surface of the wrap 12 and the side surface of the wrap 16 slide while being in close contact with each other, the radius of revolution of the revolving scroll 14 varies automatically. In keeping with this, the eccentric driving pin 25 slides in the slide groove 24 in the longitudinal direction thereof, and outer end surfaces of the drive bushing 21 and the balance weight 27 slide on the inner end surface of the rotary shaft 7.

In the above-described scroll type fluid machinery, the center of gravity of the balance weight 27 is located to the left of the drive bushing 21 in the figure. Further, outer end surfaces of the drive bushing 21 and the balance weight 27 are slidable on the inner end surface of the rotary shaft 7, and the eccentric driving pin 25 is fitted into the slide groove 24 slidably. Therefore, when the revolving scroll 14 is revolving in a solar motion, the balance weight 27 and the drive bushing 21 formed in one body therewith rotate with tilting counterclockwise in the figure by means of centrifugal force acting on the center of gravity of the balance weight 27. As a result, there has been such a problem that unilateral working is produced on the rotating bearing 23 and the outer end surface of the drive bushing 21 works unilaterally on the inner end surface of the rotary shaft 7.

OBJECT AND SUMMARY OF THE INVENTION

It is an object of the present invention which has been made in view of such a point to provide a scroll type fluid machinery in which above-described problems are solved, unilateral working of a rotating bearing is prevented, and unilateral working between an outer end surface of a drive bushing and an inner end surface of a rotary shaft is also prevented.

In order to achieve the above-described object, according to the construction of the present invention, there is provided a scroll type fluid machinery in which a stationary scroll and a revolving scroll having spiral wraps set up on inner surfaces of end plates, respectively, are engaged with each other, a drive bushing is inserted rotatably into a boss which is projected at a central part of the outer surface of the end plate of the revolving scroll, an eccentric driving pin projected at an inner end of a rotary shaft is fitted slidably into a slide groove which is bored in the drive bushing, and a balance weight for balancing dynamic unbalance caused by revolution in a solar motion of the revolving scroll is provided on the drive bushing, characterized in that a tilted rotation regulating member is projected at the inner end of the rotary shaft, the tilted rotation regulating member penetrates through a hole which is bored in the drive bushing or the balance weight and has a size which allows sliding of the drive bushing, and a regulating surface which is in contact slidably with the inner end surface of the drive bushing or the balance weight is provided at a tip of the tilted rotation regulating member.

It is also possible to construct the above-mentioned tilted rotation regulating member with a bolt provided with a head which forms the regulating surface.

It is also possible to have a shim interposed between the regulating surface and the inner end surface of the drive bushing or the balance weight.

It is also possible to install a snap ring which constructs the regulating surface at a tip of a pin which forms the tilted rotation regulating member.

The present invention being provided with the above-described construction, the operation thereof is performed in such a manner that, when the radius of revolution of the revolving scroll is varied, the tilted rotation regulating member moves in the hole and the regulating surface comes in contact with the inner end surface of the drive bushing or the balance weight slidably so as to regulate tilted rotation of the drive bushing and the balance weight.

As the effects of the present invention, tilted rotation of the drive bushing and the balance weight is regulated when the revolving scroll is revolving in a solar motion, thus making it possible to prevent flaking and wear between the drive bushing and the rotating bearing and between the outer end surface of the drive bushing or the balance weight and the inner end surface of the rotary shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Preferred embodiments of the present invention will be described in detail hereafter in an illustrative manner with reference to the drawings.

Figure 1:
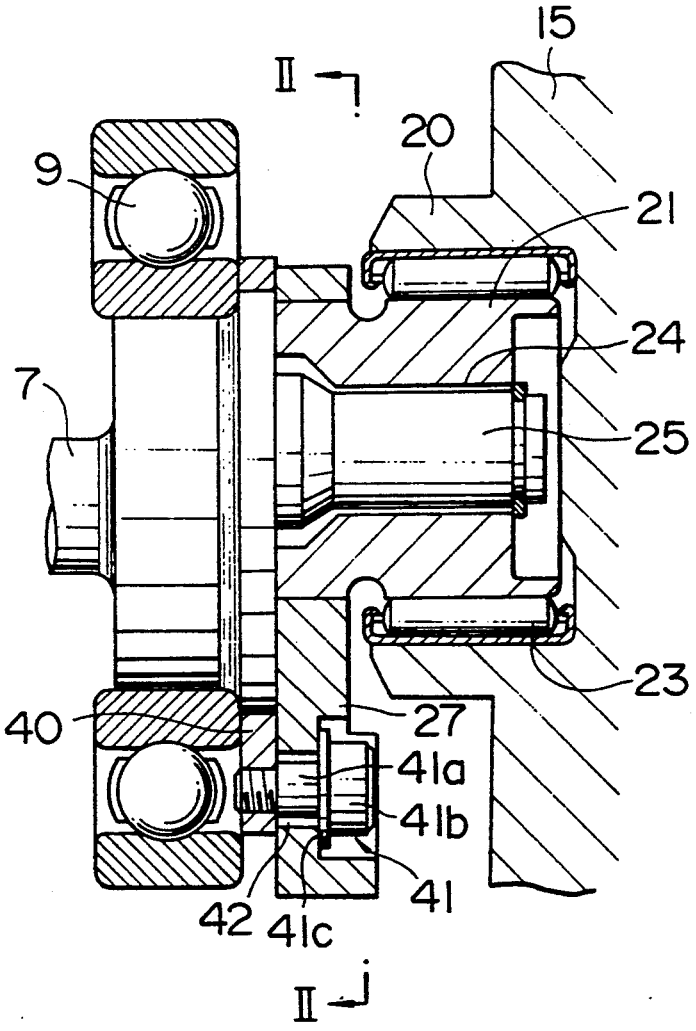
FIG. 1 is a partial sectional view taken along a line I—I in FIG. 2, showing a first embodiment of the present invention.
Figure 2:
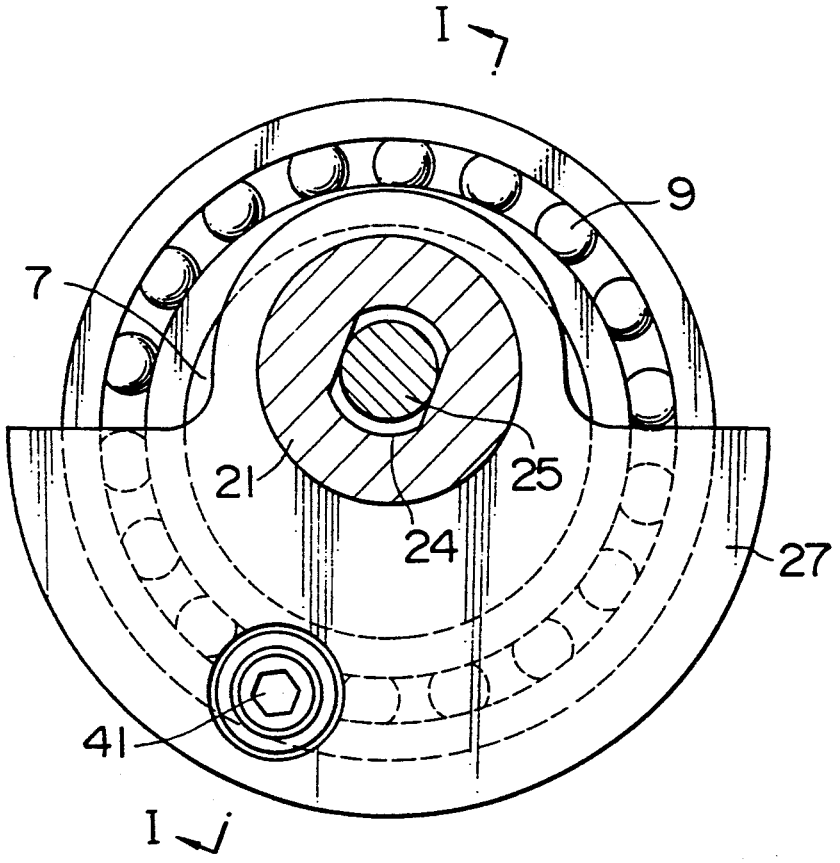
FIG. 2 is a cross sectional view taken along a line II—II in FIG. 1.

FIG. 1 and FIG. 2 show a first embodiment of the present invention, wherein FIG. 1 is a partial longitudinal sectional view taken along a line I—I in FIG. 2 and FIG. 2 is a cross sectional view taken along a line II—II in FIG. 1.

As shown in FIG. 1 and FIG. 2, a collar 40 is provided at an inner end of a rotary shaft 7, and a tilted rotation regulating bolt 41 is installed fixedly on the collar 40. A shaft portion **41*a* of this bolt 41 penetrates through a hole 42 bored in a balance weight 27, and a bearing surface 41*c* of a head 41*b* thereof is in contact slidably with an inner end surface of the balance weight 27. Further, the hole 42 is formed in a size which allows sliding of a drive bushing 21**.

Figure 5:
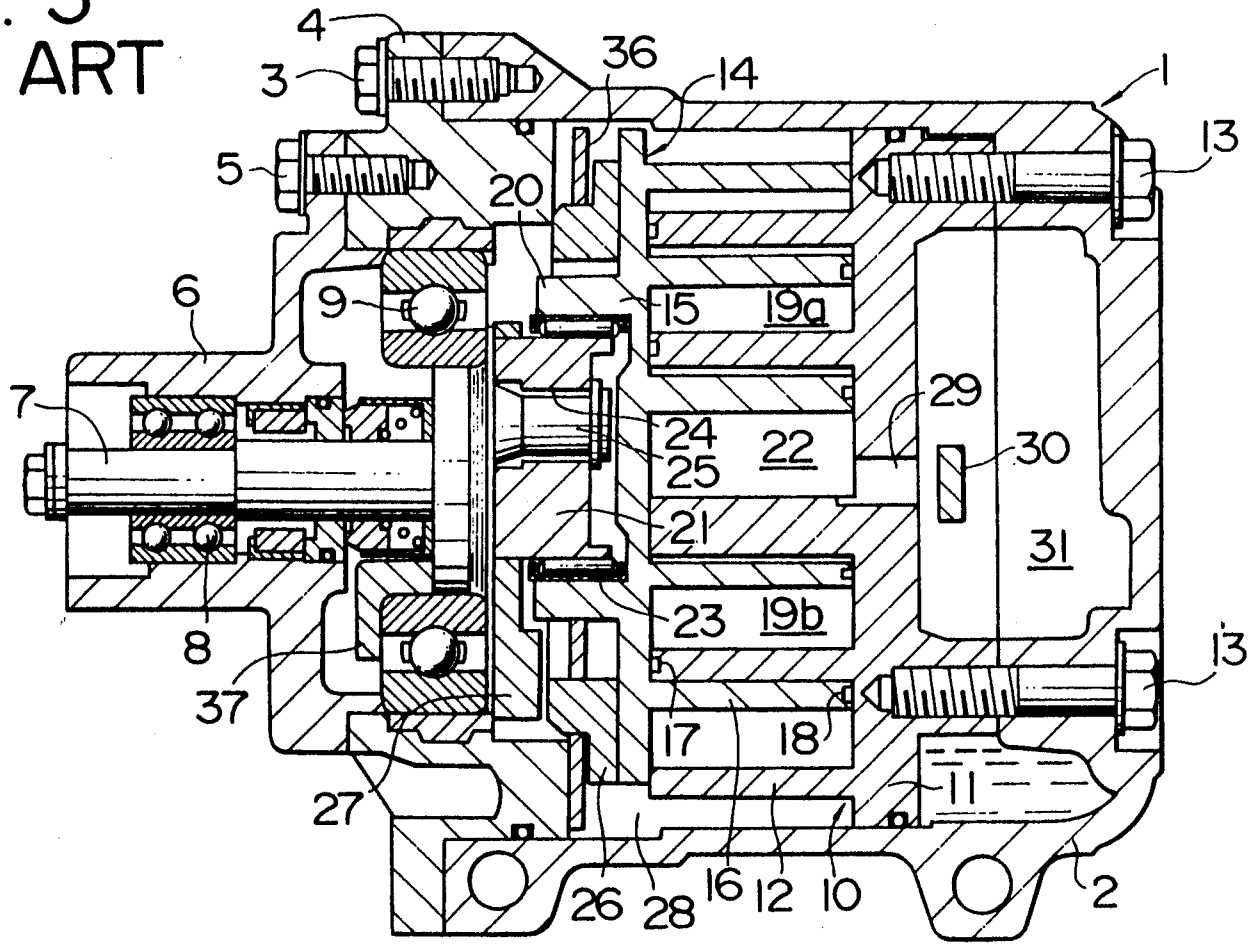
FIG. 5 PRIOR ART
FIG. 5 is a longitudinal sectional view of a conventional scroll type compressor.

Other construction is similar to that of a conventional device shown in FIG. 5, and the same reference numerals are affixed to corresponding members.

Now, when the radius of revolution of a revolving scroll 14 is varied, an eccentric driving pin 25 slides in a slide groove 24 in accordance with the variation, and the shaft portion **41*a* of the tilted rotation regulating bolt 41 slides in the hole 42 at the same time. Further, the bearing surface 41*c* of the head 41*b* comes in slidable contact with the inner end surface of the balance weight 27 so as to regulate tilted rotation of the balance weight 27 and the drive bushing 21**.

It is possible to control tilted rotation quantity of the drive bushing 21 easily by adjusting the screwing quantity of the tilted rotation regulating bolt 41 into the collar 40. Further, since the bolt 41 is apart from the center of the drive bushing 21, tilted rotation of the drive bushing 21 can be regulated effectively.

Figure 3:
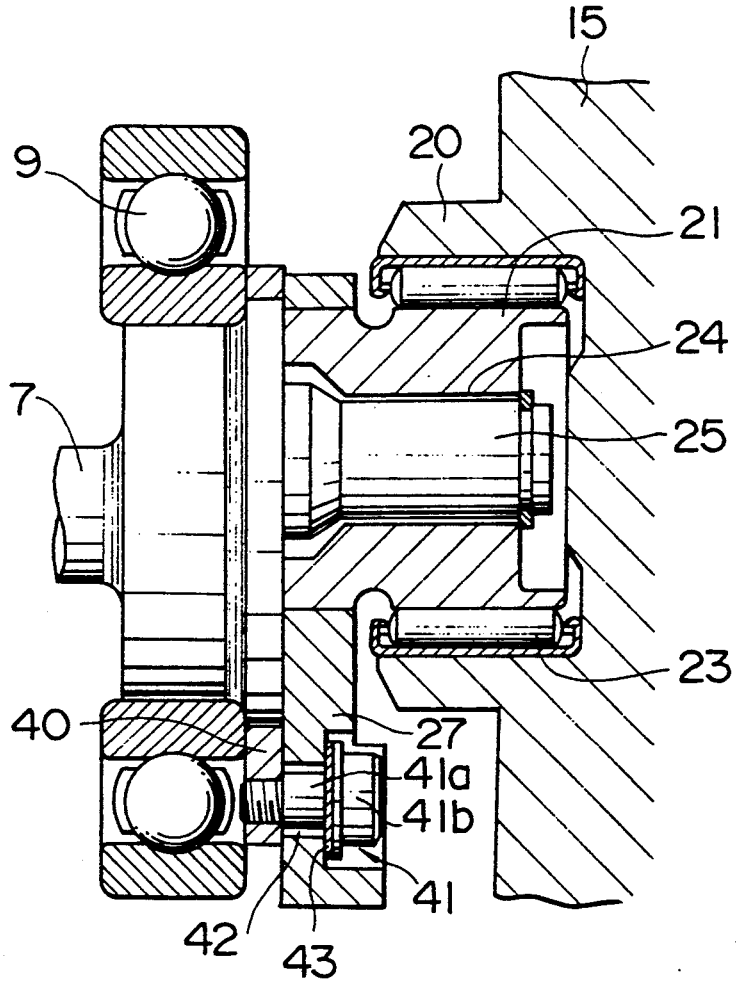
FIG. 3 is a partial longitudinal sectional view corresponding to FIG. 1 showing a second embodiment of the present invention.

FIG. 3 shows a second embodiment of the present invention. This second embodiment is different from the first embodiment in a point that a shim 43 is interposed between the bearing surface of the head **41*b* and the inner end surface of the balance weight 27**, but other construction remains the same, and the same reference numerals are affixed to corresponding members.

In the second embodiment, it is possible to prevent fretting between the bearing surface of the head **41*b* and the inner end surface of the balance weight 27 by means of the shim 43, and also to relieve working precision of respective components by selecting the wall thickness of the shim 43** appropriately.

Figure 4:
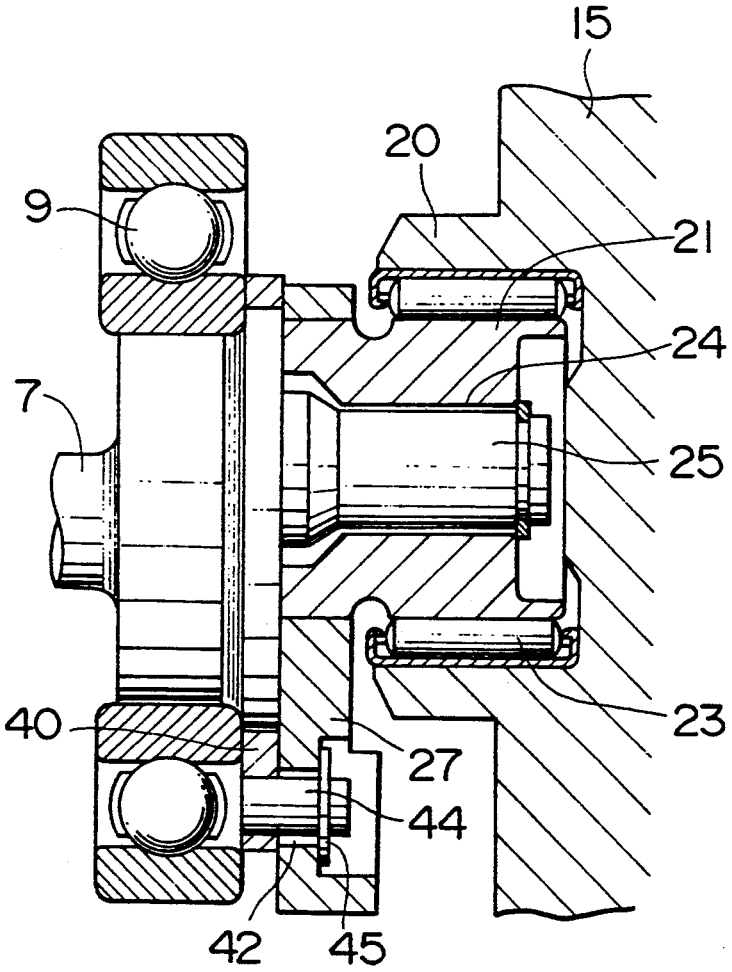
FIG. 4 is a partial longitudinal sectional view corresponding to FIG. 1 showing a third embodiment of the present invention.

FIG. 4 shows a third embodiment of the present invention. In the third embodiment, a pin 44 is fixed to the collar 40, and a left end surface of a snap ring H5 locked to the head of the pin 44 is made to come into slidable contact with the inner end surface of the balance weight 27.

Other construction is similar to that of the first embodiment, and the same reference numbers are affixed to corresponding members.

In above-mentioned respective embodiments, the bolt 41 or the pin 44 is fixed to the collar 40, but it is possible to install a tilted rotation regulating member having an optional configuration and structure projecting at the inner end of the rotary shaft 7, and it is also possible to directly regulate tilted rotation of the drive bushing 21 by the regulating surface provided on the tilted rotation regulating member.

As it is apparent from the explanation described above, according to the present invention, a tilted rotation regulating member is projected at an inner end of a rotary shaft, the tilted rotation regulating member is made to penetrate through a hole which is bored in a drive bushing or a balance weight and has a size which allows sliding of the drive bushing, and a regulating surface which comes into slidable contact with the inner end surface of the drive bushing or the balance weight is provided at the tip thereof. Thus, tilted rotation of the drive bushing and the balance weight is regulated when the revolving scroll is revolving in a solar motion, thus making it possible to prevent flaking and wear between the drive bushing and the rotating bearing and between the outer end surface of the drive bushing or the balance weight and the inner end surface of the rotary shaft.

We claim:

1. A scroll type fluid machinery comprising a stationary scroll and a revolving scroll both having end plates with inner and outer surfaces, spiral wraps being provided on the inner surfaces of the end plates of both the stationary scroll and the revolving scroll, the spiral wraps being engaged with each other, a boss of said end plate on said revolving scroll, a drive bushing being inserted rotatably into said boss which is projected at a central part of the outer surface of the end plate of said revolving scroll, an eccentric driving pin projected at an end of a rotary shaft being fitted slidably into a slide groove which is bored in said drive bushing, and a balance weight for balancing dynamic unbalance caused by revolution in a solar motion of said revolving scroll being provided on said drive bushing, a tilted rotation regulating member projecting from the end of said rotary shaft penetrates through a hole which is bored in said balance weight, the hole having a size which allows sliding of said drive bushing, and a regulating surface being in slidable contact with an end surface of said balance weight being provided at a tip of said tilted rotation regulating member.

2. The scroll type fluid machinery according to claim 1, wherein said tilted rotation regulating member is constructed of a bolt provided with a head which forms said regulating surface.

3. The scroll type fluid machinery according to claim 1, wherein a shim is interposed between said regulating surface and the end surface of said balance weight.

4. The scroll type fluid machinery according to claim 1, wherein a snap ring which forms said regulating surface is installed at a tip of a pin forming said titled rotation regulating member.

* * * * *